US010472193B2

(12) United States Patent
Ohno

(10) Patent No.: US 10,472,193 B2
(45) Date of Patent: Nov. 12, 2019

(54) IMAGE FORMING APPARATUS AND GUIDANCE METHOD FOR PAPER FEEDING WORK

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Masahiro Ohno, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/170,096

(22) Filed: Oct. 25, 2018

(65) Prior Publication Data

US 2019/0062089 A1 Feb. 28, 2019

Related U.S. Application Data

(63) Continuation of application No. 15/464,660, filed on Mar. 21, 2017, now Pat. No. 10,138,084.

(51) Int. Cl.

| | |
|---|---|
| ***B65H 7/06*** | (2006.01) |
| ***B65H 7/00*** | (2006.01) |
| ***B65H 1/26*** | (2006.01) |
| ***B65H 7/20*** | (2006.01) |
| ***B65H 7/02*** | (2006.01) |

(52) U.S. Cl.

CPC ..... *B65H 7/06* (2013.01); *B65H 1/266* (2013.01); *B65H 7/00* (2013.01); *B65H 7/02* (2013.01); *B65H 7/20* (2013.01); *B65H 2405/12* (2013.01); *B65H 2405/311* (2013.01); *B65H 2407/20* (2013.01); *B65H 2701/139* (2013.01); *B65H 2701/1829* (2013.01); *B65H 2801/06* (2013.01)

(58) Field of Classification Search

CPC ... B65H 7/20; B65H 7/18; B65H 7/14; B65H 7/06; B65H 7/00; B65H 7/02; B65H 1/266; B65H 2405/31; B65H 2405/311; B65H 2701/139; B65H 2701/182; B65H 2701/1829; B65H 2301/4221; B65H 2701/1828

USPC ..... 271/21, 258.03, 259

See application file for complete search history.

(56) References Cited

U.S. PATENT DOCUMENTS

| | | | |
|---|---|---|---|
| 3,350,089 | A | 10/1967 | Niccoli |
| 5,137,269 | A | 8/1992 | Yamamoto |
| 6,546,210 | B1 | 4/2003 | Nakamura |
| 7,460,825 | B2 | 12/2008 | Sawanaka et al. |
| 7,695,037 | B2 | 4/2010 | Rhodes |
| 9,871,934 | B2 | 1/2018 | Takahashi et al. |

(Continued)

OTHER PUBLICATIONS

Non-Final Office Action for U.S. Appl. No. 15/464,660 dated Jan. 12, 2018.

*Primary Examiner* — Jeremy R Severson

(74) *Attorney, Agent, or Firm* — Amin, Turocy & Watson LLP

(57) ABSTRACT

An image forming apparatus of embodiments includes an accommodation unit and a notification unit. The accommodation unit accommodates both of a paper bundle and a packaging member therein in a state in which at least one of the paper bundle and the packaging member used to package the paper bundle satisfies predetermined conditions. The notification unit performs a notification of guidance on the predetermined conditions.

3 Claims, 9 Drawing Sheets

(56) References Cited

U.S. PATENT DOCUMENTS

| | | | |
|---|---|---|---|
| 2001/0011795 | A1 | 8/2001 | Ohtsuka et al. |
| 2007/0126172 | A1 | 6/2007 | Nakamura et al. |
| 2010/0289213 | A1 | 11/2010 | Yahata |
| 2016/0145060 | A1 | 5/2016 | Ohno |
| 2017/0081138 | A1 | 3/2017 | Ohno |

IMAGE FORMING APPARATUS AND GUIDANCE METHOD FOR PAPER FEEDING WORK

CROSS-REFERENCE TO RELATED APPLICATIONS

This application is a Continuation of application Ser. No. 15/464,660 filed on Mar. 21, 2017, the entire contents of which are incorporated herein by reference.

FIELD

Embodiments described herein relate generally to an image forming apparatus and a guidance method for paper feeding work.

BACKGROUND

A paper feeding device accommodating both a paper bundle and a packaging member has been proposed.

Meanwhile, further improvement of convenience is expected for an image forming apparatus.

DETAILED DESCRIPTION

Figure 1:
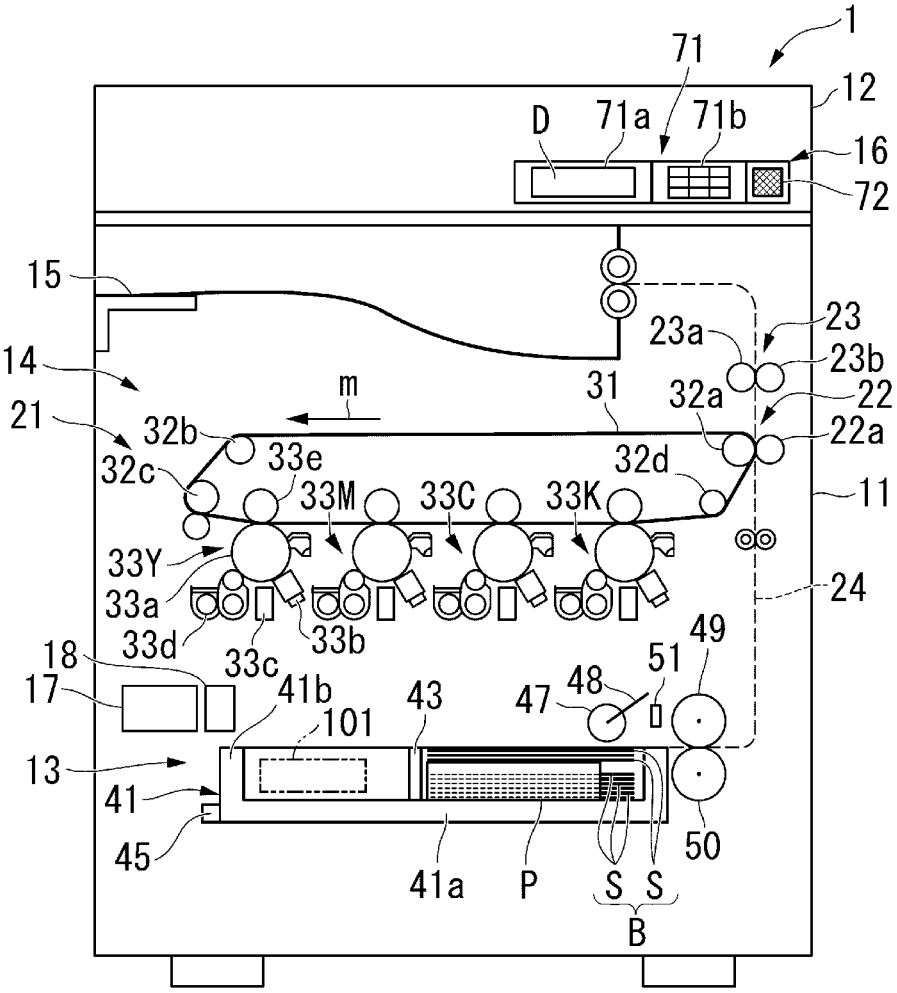
FIG. 1 is a front view illustrating the entire configuration of an image forming apparatus according to a first embodiment.

An image forming apparatus of embodiments includes an accommodation unit and a notification unit. The accommodation unit accommodates both a paper bundle and a packaging member therein in a state in which at least one of the paper bundle and the packaging member used to package the paper bundle satisfies predetermined conditions. The notification unit performs a notification of guidance on the predetermined conditions.

Hereinafter, with reference to the drawings, a description will be made of an image forming apparatus and a guidance method for paper feeding work. In the following description, constituent elements having the same or similar function are given the same reference numerals. Repeated description of the constituent elements will be omitted in some cases. In the following description, an "upper side" and a "lower side" in a paper bundle B and a packaging member P respectively indicate an "upper side" and a "lower side" with a state in which the paper bundle B and the packaging member P are accommodated in a paper feeding cassette 41 of an image forming apparatus 1 as a reference. A "paper carrying direction X" indicates a direction in which a paper sheet S is carried from a pickup roller 47 toward a paper feeding roller 49 which will be described later.

First Embodiment

FIG. 1 is a front view illustrating the entire configuration of the image forming apparatus 1 according to the first embodiment. For example, the image forming apparatus 1 is a multi-function peripheral (MFP). However, the image forming apparatus 1 is not limited to the above-described example, and may be a copier, a printer, or the like.

The image forming apparatus 1 includes a casing 11, a scanner unit 12, a paper feeding unit 13, a printer unit 14, a paper discharge unit 15, a user interface 16, a control unit 17, and a storage unit 18.

The casing 11 forms an outer frame of the image forming apparatus 1. The casing 11 accommodates the scanner unit 12, the paper feeding unit 13, the printer unit 14, the control unit 17, and the storage unit 18 therein.

The scanner unit 12 reads image information of an original document as digital data.

The paper feeding unit 13 feeds a paper sheet S toward the printer unit 14.

The printer unit 14 forms an image on the paper sheet S on the basis of the image information.

The paper discharge unit 15 discharges the paper sheet S on which the image has been formed by the printer unit 14.

The user interface 16 notifies a user (operator) of the image forming apparatus 1 of various pieces of information, and also receives input of various operation instructions therefrom.

The control unit 17 controls the entire image forming apparatus 1. For example, the control unit 17 controls operations of the scanner unit 12, the paper feeding unit 13, the printer unit 14, the user interface 16, and the storage unit 18.

The storage unit 18 stores various pieces of information.

Next, a description will be made of a configuration of each unit of the image forming apparatus 1.

First, the printer unit 14 will be described.

In the present embodiment, for convenience of description, an intermediate transfer type printer unit 14 will be described as an example. However, the configuration of the present embodiment is applicable to an image forming apparatus provided with a direct transfer type printer unit. The printer unit 14 includes an intermediate transfer portion (primary transfer portion) 21, a secondary transfer portion 22, a fixing device 23, and a carrying path 24.

The intermediate transfer portion 21 includes an intermediate transfer belt 31, a plurality of rollers 32*a*, 32*b*, 32*c* and 32*d*, and a plurality of image forming sections 33Y, 33M, 33C and 33K.

The intermediate transfer belt 31 is formed in an endless manner. The plurality of rollers 32*a*, 32*b*, 32*c* and 32*d* support the intermediate transfer belt 31. Consequently, the intermediate transfer belt 31 can travel endlessly in a direction indicated by an arrow m in FIG. 1.

The plurality of image forming sections 33Y, 33M, 33C and 33K includes a yellow image forming section 33Y, a magenta image forming section 33M, a cyan image forming section 33C, and a black image forming section 33K. Each of the image forming sections 33Y, 33M, 33C and 33K includes a photoconductive drum 33*a*, a charger 33*b*, an exposure device 33*c*, a developer 33*d*, and a transfer roller 33*e*. Each of the image forming sections 33Y, 33M, 33C and 33K transfers (primarily transfers) a toner image formed on a surface of the photoconductive drum 33*a* onto the intermediate transfer belt 31.

The secondary transfer portion 22 includes a transfer roller 22*a*. The transfer roller 22*a* is in contact with an outer surface of the intermediate transfer belt 31. The belt roller 32*a* as one of the rollers supporting the intermediate transfer belt 31 is included in constituent elements of the secondary transfer portion 22. The paper sheet S is nipped between the transfer roller 22*a* and the belt roller 32*a* along with the intermediate transfer belt 31. Consequently, the toner image on the intermediate transfer belt 31 is transferred (secondarily transferred) onto the paper sheet S.

The fixing device 23 includes a heat roller 23*a* and a press roller 23*b*. The fixing device 23 heats and presses the paper sheet S passing between the heat roller 23*a* and the press roller 23*b*. Consequently, the toner image transferred onto the paper sheet S is fixed to the paper sheet S.

The carrying path 24 reaches the paper discharge unit 15 from the paper feeding unit 13 through the secondary transfer portion 22 and the fixing device 23. The paper sheet S is carried along the carrying path 24 so as to be moved from the paper feeding unit 13 to the paper discharge unit 15 through the secondary transfer portion 22 and the fixing device 23.

Next, the paper feeding unit 13 will be described.

Figure 2:
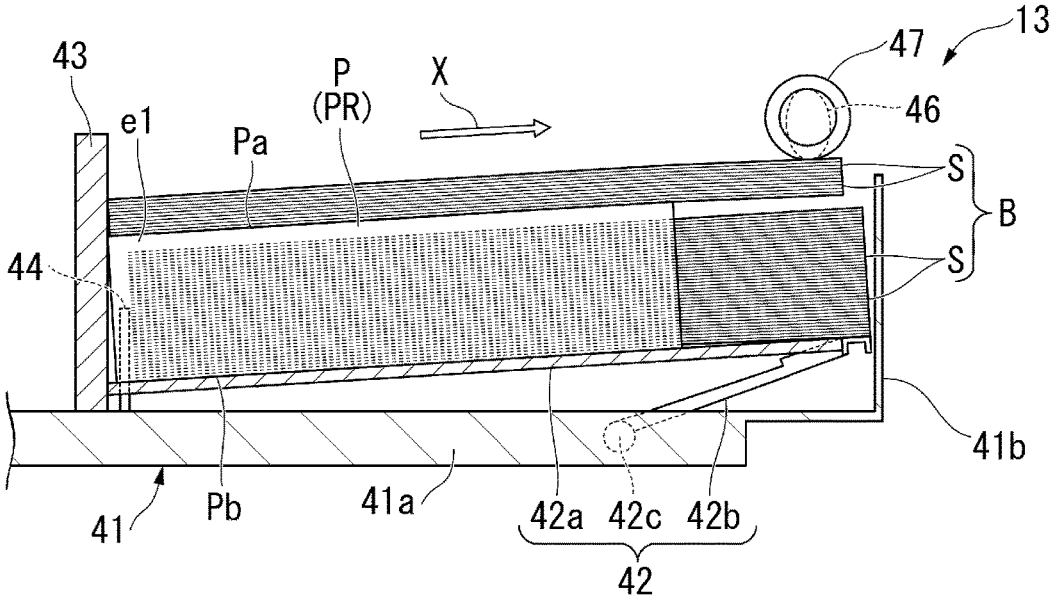
FIG. 2 is a sectional view illustrating a paper feeding unit.

FIG. 2 is a sectional view illustrating the paper feeding unit 13.

As illustrated in FIG. 2, the paper feeding unit 13 includes the paper feeding cassette 41, a paper lift mechanism 42, an end guide 43, a holding member 44, a cassette sensor 45 (refer to FIG. 1), an empty sensor 46, the pickup roller 47, a pickup roller driving mechanism 48 (refer to FIG. 1), the paper feeding roller 49 (refer to FIG. 1), a separation roller 50 (refer to FIG. 1), and a paper behavior detection sensor 51 (refer to FIG. 1).

The paper feeding cassette 41 is an example of an "accommodation unit". The paper feeding cassette 41 has a bottom wall 41*a* and a sidewall 41*b* standing from a peripheral edge of the bottom wall 41*a*, and is thus formed in a state in which an upper part thereof is open. The paper feeding cassette 41 is attached to the casing 11 so as to be extractable therefrom.

In the present embodiment, the paper feeding cassette 41 accommodates both of the paper bundle B and the packaging member P in a state in which at least one of the paper bundle B and the packaging member P in which the paper bundle B is packaged satisfies predetermined conditions. The packaging member P is, for example, packaging paper. However, the packaging member P may not be made of paper.

Here, a description will be made of an example of the "predetermined conditions".

Figure 3:
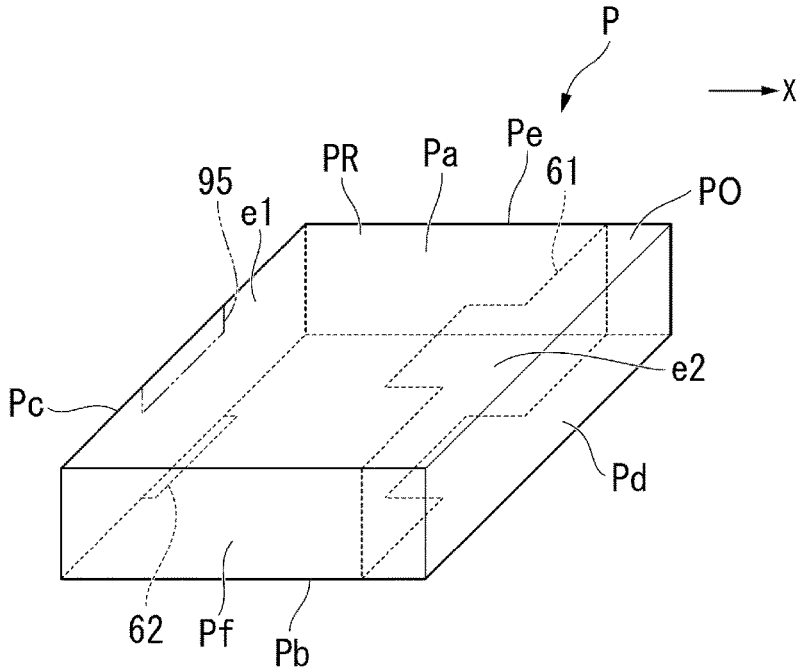
FIG. 3 is a perspective view illustrating a packaging member according to the first embodiment.

FIG. 3 is a perspective view illustrating the packaging member P of the present embodiment. FIG. 3 illustrates the packaging member P in a state before the paper bundle B and the packaging member P are accommodated in the paper feeding cassette 41 (a state in which the packaging member P is not opened).

As illustrated in FIG. 3, the packaging member P has an upstream side end e1 located on the upstream side in the paper carrying direction X and a downstream side end e2 located on the downstream side in the paper carrying direction X, with an attitude of the packaging member P being accommodated in the paper feeding cassette 41 as a reference.

The packaging member P has an upper surface Pa, a lower surface Pb, a first side surface Pc, a second side surface Pd, a third side surface Pe, and a fourth side surface Pf, with the attitude of the packaging member P being accommodated in the paper feeding cassette 41 as a reference. The upper surface Pa comes into contact with the pickup roller 47 which will be described later if the packaging member P is accommodated in the paper feeding cassette 41. The lower surface Pb is located on an opposite side to the upper surface Pa. Each of the first side surface Pc, the second side surface Pd, the third side surface Pe, and the fourth side surface Pf reaches the upper surface Pa from the lower surface Pb. The first side surface Pc is located at the upstream side end e1 of the packaging member P. The second side surface Pd is located at the downstream side end e2 of the packaging member P. Each of the third side surface Pe and the fourth side surface Pf reaches over the first side surface Pc and the second side surface Pd along the paper carrying direction X. The fourth side surface Pf is located on an opposite side to the third side surface Pe.

The packaging member P has a first cutting guide line 61 and a second cutting guide line 62. For example, each of the first cutting guide line 61 and the second cutting guide line 62 is perforations provided on the packaging member P.

The first cutting guide line 61 is provided at the downstream side end e2 of the packaging member P. The first cutting guide line 61 is continuously provided on the upper surface Pa, the lower surface Pb, the third side surface Pe, and the fourth side surface Pf in the packaging member P. In other words, the first cutting guide line 61 is provided over the whole periphery of the packaging member P.

The second cutting guide line 62 is provided at the upstream side end e1 of the packaging member P. For example, the second cutting guide line 62 is formed in a rectangular shape on the lower surface Pb of the packaging member P.

Figure 4:
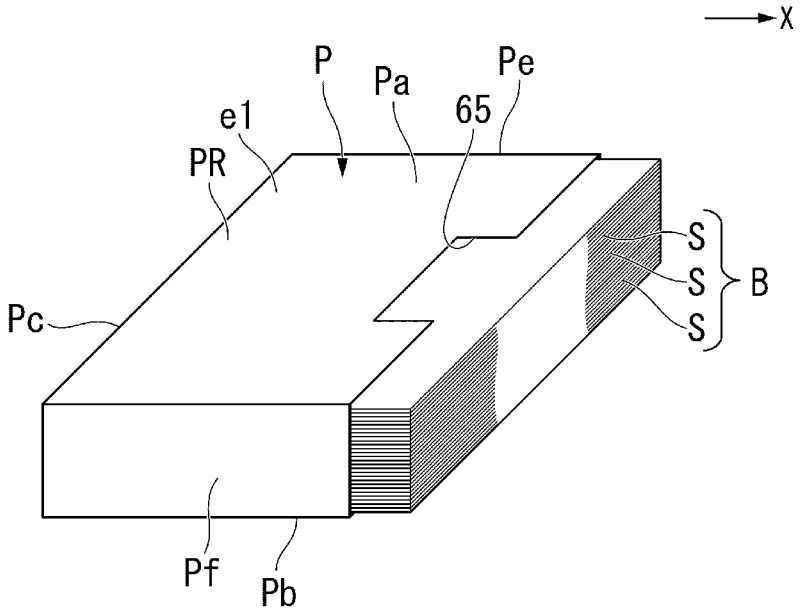
FIG. 4 is a perspective view illustrating a paper bundle and the packaging member according to the first embodiment.

FIG. 4 is a perspective view illustrating the paper bundle B and the packaging member P of the present embodiment. FIG. 4 illustrates the paper bundle B and the packaging member P in a state right before the paper bundle B and the packaging member P are accommodated in the paper feeding cassette 41.

As illustrated in FIG. 4, a part (an open portion PO illustrated in FIG. 3) of the packaging member P is separated and removed from a remaining portion PR of the packaging member P when the packaging member P is cut along the first cutting guide line 61. Consequently, in the packaging member P, the paper bundle B is exposed to the outside of the packaging member P at the downstream side end e2 of the packaging member P. For example, the open portion PO of the packaging member P is separated and removed from the remaining portion PR of the packaging member P in a region in which the paper sheet S included in the paper bundle B can be taken out by the pickup roller 47 and in a region in which a lever of the empty sensor 46 which will be described later or light transmission is not hindered.

In the present embodiment, the packaging member P is cut along the first cutting guide line 61, and thus a depression 65 is formed on the upper surface Pa of the packaging member P. The depression 65 is provided at a position corresponding to a lower side of the pickup roller 47 which will be described later. Consequently, the pickup roller 47 can be brought into contact with the paper bundle B without being hindered by the packaging member P if the pickup roller 47 is moved toward the paper bundle B.

In the present embodiment, a part of the lower surface Pb of the packaging member P is separated and removed from the remaining portion PR of the packaging member P when the packaging member P is cut along the second cutting guide line 62. Consequently, an opening 66 (refer to FIG. 6) into which the holding member 44 which will be described later is inserted is provided on the packaging member P.

Figure 5:
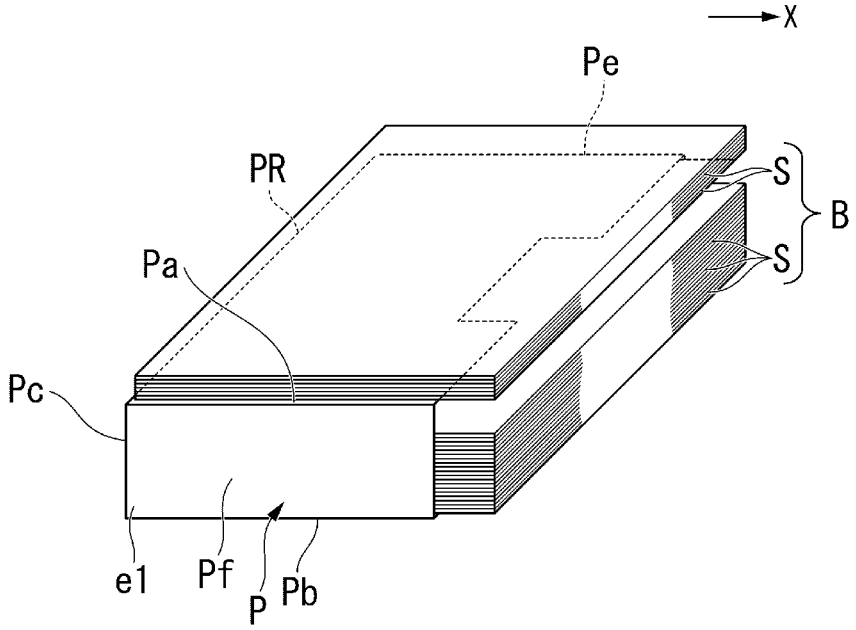
FIG. 5 is a perspective view illustrating a paper bundle and the packaging member.

FIG. 5 is a perspective view illustrating the paper bundle B and the packaging member P. FIG. 5 illustrates the paper bundle B and the packaging member P in a state in which the paper bundle B and the packaging member P are accommodated in the paper feeding cassette 41 and are set to satisfy the predetermined conditions.

As illustrated in FIG. 5, in the present embodiment, the paper bundle B and the packaging member P are accommodated in the paper feeding cassette 41 in a state in which the open portion PO of the packaging member P is removed, and some paper sheets S included in the paper bundle B are pulled out of the packaging member P and are placed on the upper surface Pa of the packaging member P. In the present embodiment, the case where some paper sheets S included in the paper bundle B are pulled out of the packaging member P and placed on the packaging member P is included in the "predetermined conditions".

In the present embodiment, after the paper bundle B and the packaging member P are accommodated in the paper feeding cassette 41, several tens of paper sheets S corresponding to an upper part of the paper bundle B are pulled out of the packaging member P and are placed on the packaging member P.

Consequently, a gap occurs between the paper sheets S inside the packaging member P and the packaging member P due to the paper sheets S being pulled out. Consequently, the friction between the paper sheet S and the paper sheet S, and the friction between the paper sheet S and the packaging member P are reduced. For example, the number of paper sheets S pulled out of the packaging member P is an amount in which a carrying force of a paper takeout member (the pickup roller 47 or the paper feeding roller 49) exceeds the friction between the paper sheet S and the paper sheet S or the friction between the paper sheet S and the packaging member P.

Next, referring to FIGS. 1 and 2 again, remaining constituent elements of the paper feeding unit 13 will be described.

The paper lift mechanism 42 includes a paper tray 42*a*, a lifting lever 42*b*, and a driving connection shaft 42*c*. The paper tray 42*a* supports the paper bundle B and the packaging member P from the lower side. The lifting lever 42*b* is connected between the paper tray 42*a* and the driving connection shaft 42*c*. The lifting lever 42*b* lifts the paper tray 42*a* obliquely so that the downstream side end of the paper bundle B is moved upward when the driving connection shaft 42*c* is rotated by a driving source (for example, a motor) (not illustrated).

The end guide 43 is provided inside the paper feeding cassette 41. The end guide 43 is located on the upstream side in the paper carrying direction X with respect to the paper bundle B and the packaging member P accommodated in the paper feeding cassette 41. The end guide 43 supports ends of the paper bundle B and the packaging member P.

The holding member 44 is provided at the end guide 43. For example, the holding member 44 is a protrusion provided at the end guide 43. If the paper bundle B and the packaging member P are accommodated in the paper feeding cassette 41, the holding member 44 passes through the opening 66 of the packaging member P. Consequently, at least a part of the holding member 44 is located inside the packaging member P. The holding member 44 holds a position of the packaging member P so that the packaging member P is not moved even if the paper sheet S is sent by the pickup roller 47 and the paper feeding roller 49.

The cassette sensor 45 is provided in the casing 11. The cassette sensor 45 detects that the paper feeding cassette 41 is extracted from the casing 11. For example, the cassette sensor 45 is a contact type sensor which comes into contact with the paper feeding cassette 41 if the paper feeding cassette 41 is not extracted from the casing 11. The cassette sensor 45 sends a detection result of the cassette sensor 45 to the control unit 17.

The empty sensor 46 is an example of a "first sensor". The empty sensor 46 detects that the paper bundle B is accommodated in the paper feeding cassette 41. For example, the empty sensor 46 is a contact type sensor which detects the paper bundle B as a result of the lever coming into contact with the paper bundle B if the paper tray 42*a* lifts the paper bundle B. However, a configuration of the empty sensor 46 is not limited to the above-described example. For example, the empty sensor 46 may be an optical sensor including a light receiving portion and a light emitting portion, or maybe other types of sensors. The empty sensor 46 sends a detection result in the empty sensor 46 to the control unit 17.

The pickup roller 47 is disposed above the paper feeding cassette 41. The pickup roller 47 comes into contact with the uppermost paper sheet S included in the paper bundle B accommodated in the paper feeding cassette 41, from above. The pickup roller 47 is driven by a pickup roller driving motor 52 (refer to FIG. 8). The pickup roller 47 sends the paper sheet S included in the paper bundle B accommodated in the paper feeding cassette 41 toward the paper feeding roller 49. The pickup roller 47 is an example of a "roller sending the paper sheet S included in the paper bundle B".

The pickup roller driving mechanism 48 retracts the pickup roller 47 upward if the paper feeding cassette 41 is extracted from the casing 11. On the other hand, if the paper feeding cassette 41 is closed with respect to the casing 11, the pickup roller driving mechanism 48 moves down the pickup roller 47 toward the uppermost paper sheet S.

The paper feeding roller 49 and the separation roller 50 are disposed further toward the downstream side than the paper feeding cassette 41 in the paper carrying direction X. Each of the paper feeding roller 49 and the separation roller 50 is driven by a driving source (for example, a motor) (not illustrated). The paper feeding roller 49 sends the paper sheet S which is sent from the paper feeding cassette 41 by the pickup roller 47, to the carrying path 24. If two paper sheets S are to be sent from the paper feeding cassette 41 by the pickup roller 47, the separation roller 50 returns the lower paper sheet S of the two paper sheets S to the paper feeding cassette 41.

The paper behavior detection sensor 51 is provided on the downstream side of the pickup roller 47 in the paper carrying direction X. For example, the paper behavior detection sensor 51 is provided between the pickup roller 47 and the paper feeding roller 49 in the paper carrying direction X. The paper behavior detection sensor 51 is an example of a "second sensor". The paper behavior detection sensor 51 detects a behavior of the paper sheet S sent by the pickup roller 47. For example, the paper behavior detection sensor 51 includes a light emitting portion which emits light downward, and a light receiving portion which receives reflected light of the light emitted from the light emitting portion. However, a configuration of the paper behavior detection sensor 51 is not limited to the above-described example. The paper behavior detection sensor 51 may be a contact type sensor which comes into contact with the paper sheet S sent by the pickup roller 47 so as to detect a behavior of the paper sheet S. The paper behavior detection sensor 51 sends a detection result in the paper behavior detection sensor 51 to the control unit 17.

Here, an operation example of the paper behavior detection sensor 51 will be described.

Figure 6:
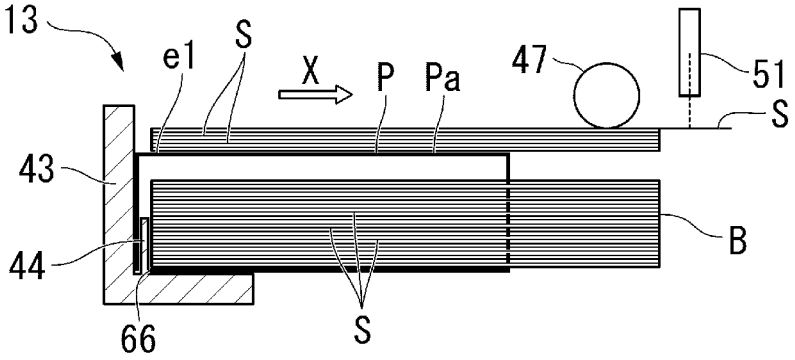
FIG. 6 is a sectional view illustrating a partial configuration of the paper feeding unit.
Figure 7:
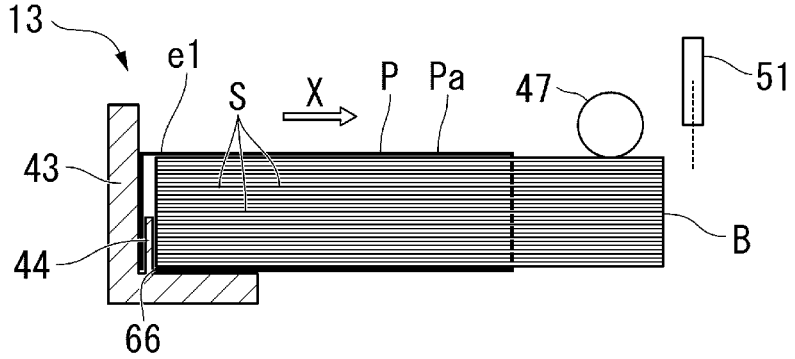
FIG. 7 is a sectional view illustrating a partial configuration of the paper feeding unit.

FIGS. 6 and 7 are sectional views illustrating a partial configuration of the paper feeding unit 13.

FIG. 6 illustrates a case where the paper sheet S is normally sent by the pickup roller 47 (a case where the paper bundle B and the packaging member P satisfy the predetermined conditions). As illustrated in FIG. 6, the paper behavior detection sensor 51 detects a behavior of the paper sheet S (for example, movement of the paper sheet S) if the paper sheet S passes under the paper behavior detection sensor 51.

On the other hand, FIG. 7 illustrates a case where the paper sheet S is not normally sent by the pickup roller 47 (a case where the paper bundle B and the packaging member P do not satisfy the predetermined conditions). As illustrated in FIG. 7, the paper behavior detection sensor 51 does not detect a behavior of the paper sheet S (for example, movement of the paper sheet S) if the paper sheet S does not pass under the paper behavior detection sensor 51.

Next, the user interface 16 will be described.

As illustrated in FIG. 1, the user interface 16 includes a control panel 71 and a speaker 72. The user interface 16 is an example of a "notification unit" which notifies a user of information.

The control panel 71 is provided with a display portion 71*a* and an input reception portion 71*b*. The display portion 71*a* includes a display screen D. The display screen D displays various pieces of information. For example, the display screen D displays guidance on an operation and work regarding the image forming apparatus 1 as text, an image, or a video. For example, the display screen D displays guidance on the predetermined conditions required to be satisfied by at least one of the paper bundle B and the packaging member P. The input reception portion 71*b* includes a plurality of buttons. The input reception portion 71*b* receives various operation instructions.

The speaker 72 outputs various pieces of information in sounds. For example, the speaker 72 outputs guidance on an operation and work regarding the image forming apparatus 1 in sounds. For example, the speaker 72 outputs guidance on the predetermined conditions required to be satisfied by at least one of the paper bundle B and the packaging member P, in sounds.

Next, the control unit 17 and the storage unit 18 will be described.

Figure 8:
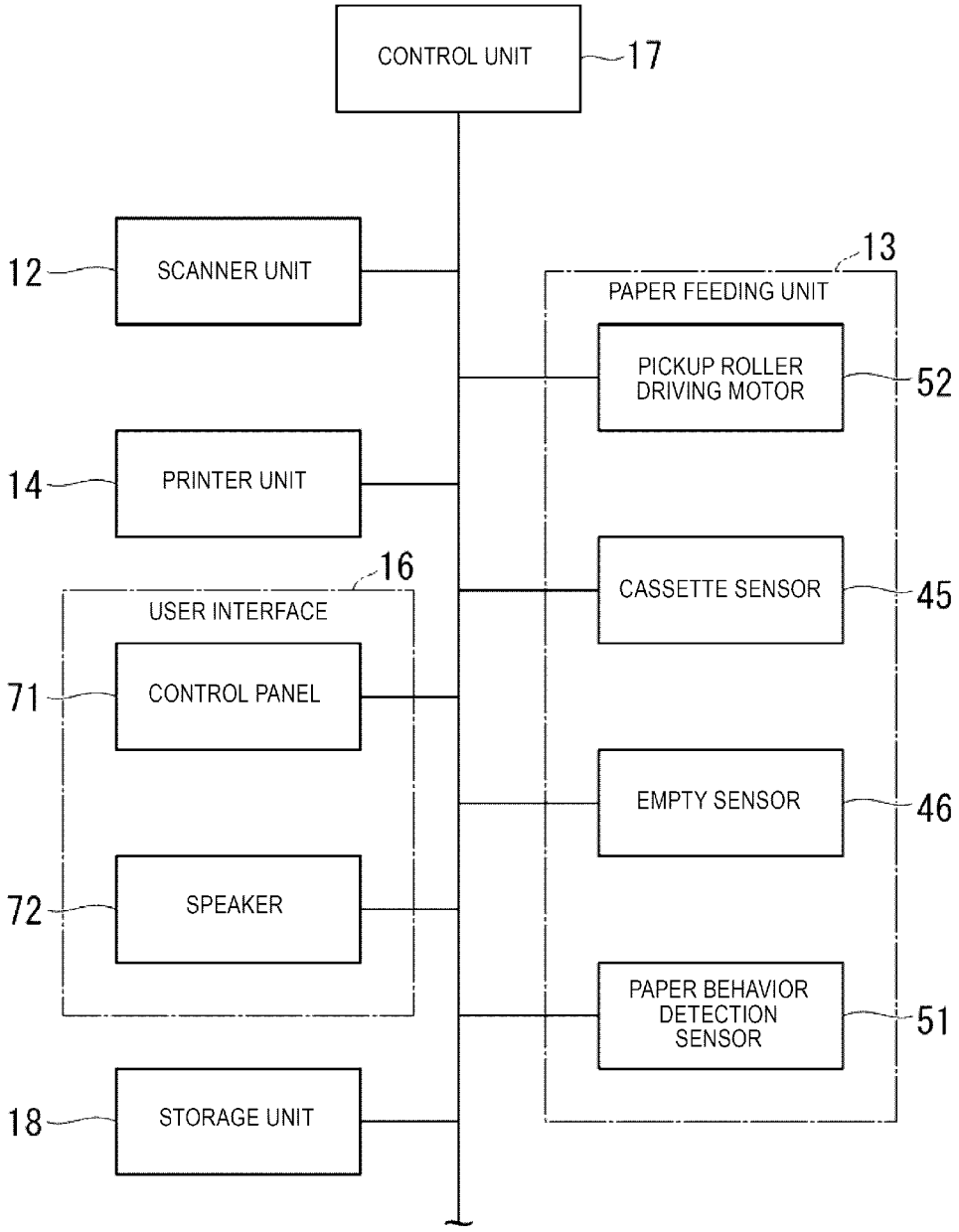
FIG. 8 is a block diagram illustrating a system configuration of the image forming apparatus.

FIG. 8 is a block diagram illustrating a system configuration of the image forming apparatus 1.

As illustrated in FIG. 8, the control unit 17 is electrically connected to the scanner unit 12, the paper feeding unit 13, the printer unit 14, the user interface 16, and the storage unit 18 via an electrical connection path such as a cable.

A part or the whole of the control unit 17 is a software functional unit which is realized, for example, by a processor (hardware processor) such as a central processing unit (CPU) executing a program (software component) stored in a memory of the image forming apparatus 1. A part or the whole of the control unit 17 may be realized by hardware such as a large scale integration (LSI), an application specific integrated circuit (ASIC), or a field programmable gate array (FPGA), and may be realized by a combination of a software functional unit and hardware. A process in the control unit 17 will be described in detail in description of a guidance operation of the image forming apparatus 1 related to paper feeding work.

The storage unit 18 is formed of at least one of a hard disk drive (HDD), a flash memory, an electrically erasable programmable read only memory (EEPROM), a read only memory (ROM), and a random access memory (RAM). The storage unit 18 stores the content of guidance displayed on the display screen D and the content of guidance output from the speaker 72.

Next, a description will be made of guidance operation of the image forming apparatus 1 related to paper feeding work.

The image forming apparatus 1 of the present embodiment performs guidance for a user who is going to perform paper feeding work (work of accommodating the paper bundle B in the paper feeding cassette 41) on the paper feeding work. This guidance includes notifying a user of guidance (hereinafter, simply referred to as "guidance") on the predetermined conditions which are required to be satisfied by at least one of the paper bundle B and the packaging member P if the paper bundle B and the packaging member P are accommodated in the paper feeding cassette 41. For example, the guidance includes not only a reminder indicating that the predetermined conditions are required to be satisfied but also the work content and work procedures regarding at least one of the paper bundle B and the packaging member P, required to satisfy the predetermined conditions. For example, in the present embodiment, the guidance includes a plurality of paper sheets S included in the paper bundle B being required to be pulled out of the packaging member P and to be placed on the packaging member P, and work procedures for pulling out a plurality of paper sheets S included in the paper bundle B from the packaging member P and placing the paper sheets S on the packaging member P.

In the present embodiment, the control unit 17 operates the user interface 16 to notify a user of the guidance. For example, the control unit 17 operates the display portion 71*a*, and thus displays the guidance on the display screen D of the display portion 71*a*. The control unit 17 operates the speaker 72, and thus outputs the guidance in sounds from the speaker 72.

Next, a description will be made of an example of a process flow in the control unit 17 of the present embodiment.

Figure 9:
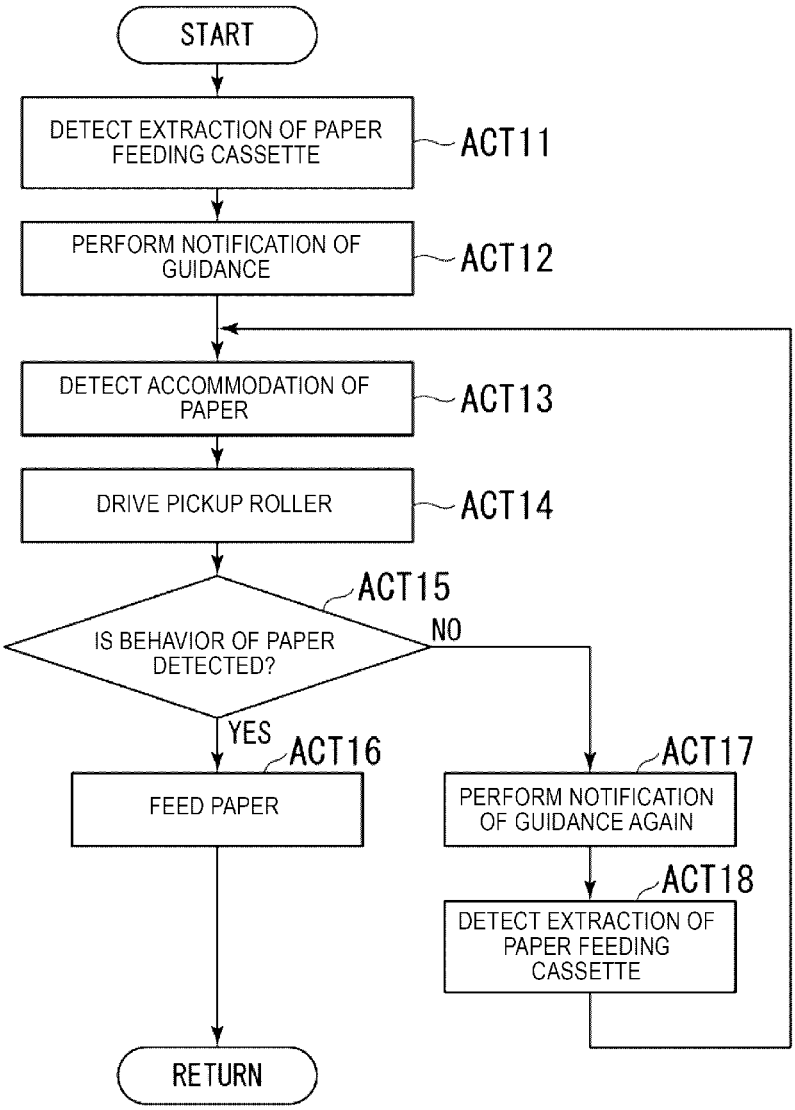
FIG. 9 is a flowchart illustrating an example of a process flow in a control unit.

FIG. 9 is a flowchart illustrating an example of a process flow in the control unit 17.

As illustrated in FIG. 9, first, if the paper feeding cassette 41 is extracted from the casing 11, the control unit 17 detects that the paper feeding cassette 41 is extracted from the casing 11 on the basis of a detection result in the cassette sensor 45 (ACT 11). If it is detected that the paper feeding cassette 41 is extracted from the casing 11, the control unit 17 controls the user interface 16 to notify the user of the guidance (ACT 12). In other words, the control unit 17 performs a notification of the guidance by operating at least one of the display screen D and the speaker 72.

Next, if the paper bundle B and the packaging member P are accommodated in the paper feeding cassette 41, and the paper feeding cassette 41 is closed with respect to the casing 11, the control unit 17 detects that the paper bundle B is accommodated in the paper feeding cassette 41 on the basis of a detection result in the empty sensor 46 (ACT 13). If it is detected that the paper bundle B is accommodated in the paper feeding cassette 41, the control unit 17 drives the pickup roller 47 (ACT 14). Here, if the paper bundle B and the packaging member P are accommodated in the paper feeding cassette 41 while satisfying the predetermined conditions, the paper sheet S included in the paper bundle B is moved downward of the paper behavior detection sensor 51 when the pickup roller 47 is driven (refer to FIG. 6). On the other hand, if the paper bundle B and the packaging member P are accommodated in the paper feeding cassette 41 while not satisfying the predetermined conditions, the paper sheet S included in the paper bundle B is not moved downward of the paper behavior detection sensor 51 even if the pickup roller 47 is driven (refer to FIG. 7).

Thus, if it is detected that the paper bundle B is accommodated in the paper feeding cassette 41, and the pickup roller 47 is driven, the control unit 17 determines whether or not a behavior of the paper sheet S is detected by the paper behavior detection sensor 51 (ACT 15).

If a behavior of the paper sheet S is detected by the paper behavior detection sensor 51 (ACT 15: YES), the control unit 17 determines that the paper bundle B and the packaging member P satisfy the predetermined conditions. In this case, the control unit 17 controls the pickup roller 47, the paper feeding roller 49, and the separation roller 50 to carry the paper sheet S from the paper feeding unit 13 toward the printer unit 14 (ACT 16).

On the other hand, if a behavior of the paper sheet S is not detected by the paper behavior detection sensor 51 (ACT 15: NO), the control unit 17 determines that the paper bundle B and the packaging member P do not satisfy the predetermined conditions. In this case, the control unit 17 controls the user interface 16 to perform a notification of the guidance again (ACT 17). In other words, the control unit 17 operates at least one of the display screen D and the speaker 72 to perform a notification of the guidance again. If the paper feeding cassette 41 is extracted from the casing 11 again, the control unit 17 detects that the paper feeding cassette 41 is extracted from the casing 11 on the basis of a detection result in the cassette sensor 45 (ACT 18). The control unit 17 performs the processes in ACT 13 and the subsequent processes again. Here, the "case where a behavior of the paper sheet S is not detected by the paper behavior detection sensor 51" indicates, for example, that there is no change in a detection result in the paper behavior detection sensor 51 for a predetermined period of time set in advance from starting of driving of the pickup roller 47.

The processes from ACT 11 to ACT 17 are performed whenever the paper feeding cassette 41 is extracted from the casing 11.

According to the image forming apparatus 1 with the above-described configuration and the guidance method for paper feeding work, it is possible to improve convenience.

Here, if the paper bundle B and the packaging member P are collectively accommodated in the paper feeding cassette 41, this is preferable since a defect hardly occurs in a set of the paper sheets S with respect to the paper feeding cassette 41. However, if the paper bundle B and the packaging member P are collectively accommodated in the paper feeding cassette 41, the friction between the paper sheet S and the paper sheet S or the friction between the paper sheet S and the packaging member P may increase. In this case, even if the paper sheet S is to be taken out with the pickup roller 47 or the paper feeding roller 49, the paper sheet S may not be taken out due to a slip.

Here, if the paper bundle B and the packaging member P are collectively accommodated in the paper feeding cassette 41, a carrying defect hardly occurs if the paper bundle B and the packaging member P are accommodated so as to satisfy predetermined conditions set in advance. However, a certain user may not know the predetermined conditions or forget the predetermined conditions and accommodate the paper bundle B and the packaging member P in the paper feeding cassette 41.

Therefore, in the present embodiment, the control unit 17 causes the user interface 16 to notify a user of the predetermined conditions. Consequently, the user can accommodate the paper bundle B and the packaging member P in the paper feeding cassette 41 so that the predetermined conditions are satisfied by knowing the predetermined conditions or recollecting the predetermined conditions. Thus, it is possible to provide the image forming apparatus 1 in which a defect hardly occurs in a set of the paper sheets S with respect to the paper feeding cassette 41, and the paper sheets S can be easily set.

In the present embodiment, the predetermined conditions include a plurality of paper sheets S included in the paper bundle B being pulled out of the packaging member P and being placed on the packaging member P. According to this configuration, it is possible to reduce the friction between the paper sheet S and the paper sheet S and the friction between the paper sheet S and the packaging member P. Consequently, it is possible to prevent carrying defects caused by the friction.

In the present embodiment, if the empty sensor 46 detects that the paper bundle B is accommodated in the paper feeding cassette 41, and the pickup roller 47 is driven, the control unit 17 controls the user interface 16 to perform a notification of the guidance when a behavior of the paper sheet S is not detected by the paper behavior detection sensor 51. According to this configuration, a user can be notified of the guidance again if the paper sheet S is not carried by detecting whether or not the paper sheet S can be carried. Consequently, it is possible to further increase a user's convenience.

Second Embodiment

Next, with reference to FIGS. 10 and 11, a second embodiment will be described. The present embodiment is different from the first embodiment in that a behavior of the paper sheet S is detected by the paper behavior detection sensor 51 in a state in which movement of a leading end of the paper sheet S is restricted. Other configurations than those described below are the same as the configurations in the first embodiment.

Figure 10:
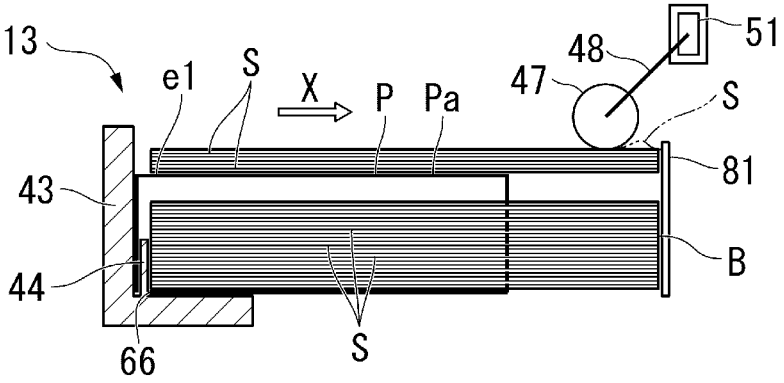
FIG. 10 is a sectional view illustrating a partial configuration of a paper feeding unit according to a second embodiment.

FIG. 10 is a sectional view illustrating a partial configuration of the paper feeding unit 13 according to the present embodiment.

As illustrated in FIG. 10, the paper feeding unit 13 of the present embodiment includes a paper stopper 81. The paper stopper 81 is an example of a "restriction member". The paper stopper 81 is provided on the downstream side of the pickup roller 47 in the paper carrying direction X. For example, the paper stopper 81 is provided between the pickup roller 47 and the paper feeding roller 49 in the paper carrying direction X. The paper stopper 81 is movable between a restriction position and a retraction position by a driving mechanism (not illustrated). At the restriction position, the paper stopper 81 comes into contact with the paper sheet S from the downstream side in the paper carrying direction X so as to restrict movement of the leading end of the paper sheet S. At the retraction position, the paper stopper 81 permits movement of the paper sheet S.

In the present embodiment, the paper behavior detection sensor 51 is connected to the pickup roller driving mechanism 48. The paper behavior detection sensor 51 detects a behavior of the paper sheet S on the basis of a change in a height position of the pickup roller 47. The paper behavior detection sensor 51 of the present embodiment detects bending of the paper sheet S as a behavior of the paper sheet S.

Here, FIG. 10 illustrates a case where the paper sheet S is normally sent by the pickup roller 47 (a case where the paper bundle B and the packaging member P satisfy the predetermined conditions). As illustrated in FIG. 10, if the paper sheet S is normally sent by the pickup roller 47, a leading end of the paper sheet S sent by the pickup roller 47 collides with the paper stopper 81, and thus movement thereof is restricted. If the pickup roller 47 is further driven in a state in which the movement of the leading end of the paper sheet S is restricted, bending occurs in the paper sheet S. In this case, the pickup roller 47 is lifted upward due to the bending of the paper sheet S. The paper behavior detection sensor 51 detects the bending of the paper sheet S when a height position of the pickup roller 47 changes.

Figure 11:
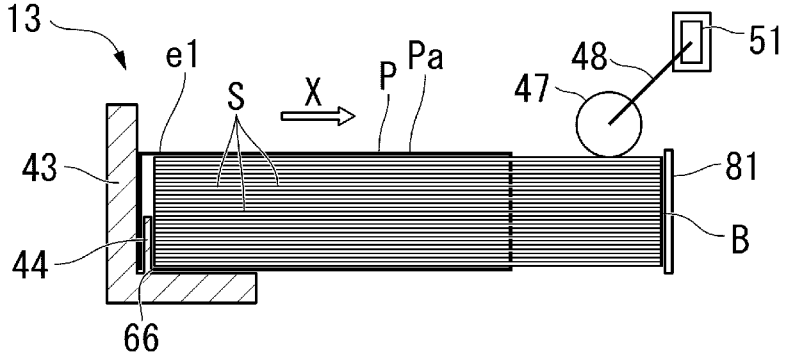
FIG. 11 is a sectional view illustrating a partial configuration of the paper feeding unit.

On the other hand, FIG. 11 illustrates a case where the paper sheet S is not normally sent by the pickup roller 47 (a case where the paper bundle B and the packaging member P do not satisfy the predetermined conditions). As illustrated in FIG. 11, if the paper sheet S is not normally sent by the pickup roller 47, bending does not occur in the paper sheet S. In this case, the pickup roller 47 is not lifted upward. As a result, the paper behavior detection sensor 51 does not detect bending of the paper sheet S.

In the present embodiment, if it is detected that the paper bundle B is accommodated in the paper feeding cassette 41, the control unit 17 moves the paper stopper 81 to the restriction position and also drives the pickup roller 47. The control unit 17 determines whether or not a behavior of the paper sheet S (bending of the paper sheet S) is detected by the paper behavior detection sensor 51. In the present embodiment, if bending of the paper sheet S is detected by the paper behavior detection sensor 51, the control unit 17 determines that the paper bundle B and the packaging member P satisfy the predetermined conditions.

On the other hand, if a behavior of the paper sheet S (bending of the paper sheet S) is not detected by the paper behavior detection sensor 51, the control unit 17 determines that the paper bundle B and the packaging member P do not satisfy the predetermined conditions. In this case, the control unit 17 controls the user interface 16 to perform a notification of the guidance again.

According to this configuration, it is possible to improve convenience in the same manner as in the first embodiment. However, a configuration of the paper behavior detection sensor 51 is not limited to the above-described example. The paper behavior detection sensor 51 may be a sensor which is provided separately from the pickup roller driving mechanism 48. For example, the paper behavior detection sensor 51 may be a sensor which is indirect contact with bending of the paper sheet S or detects bending of the paper sheet S in an optical method. This is also the same for a third embodiment.

Third Embodiment

Next, with reference to FIGS. 12 and 13, the third embodiment will be described. The present embodiment is different from the second embodiment in that a paper detection roller 91 is provided separately from the pickup roller 47. Other configurations than those described below are the same as the configurations in the second embodiment.

Figure 12:
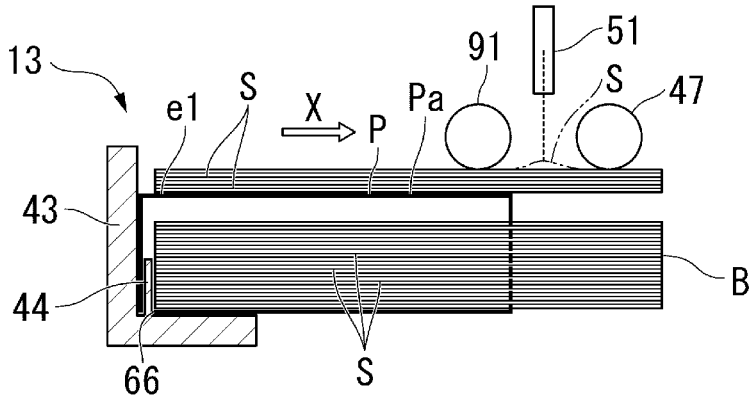
FIG. 12 is a sectional view illustrating a partial configuration of a paper feeding unit according to a third embodiment.

FIG. 12 is a sectional view illustrating a partial configuration of the paper feeding unit 13 according to the present embodiment.

As illustrated in FIG. 12, in the present embodiment, the pickup roller 47 is an example of a "restriction member" which restricts movement of a leading end of the paper sheet S. The pickup roller 47 is in contact with the paper sheet S so as to restrict movement of the leading end of the paper sheet S in a state in which the pickup roller 47 is controlled so that the pickup roller 47 is not rotated.

In the present embodiment, the paper feeding unit 13 includes the paper detection roller 91. The paper detection roller 91 is provided on the upstream side of the pickup roller 47 in the paper carrying direction X. The paper detection roller 91 is a driving roller which is driven by a driving source (for example, a motor) (not illustrated). The paper detection roller 91 is an example of a "roller sending the paper sheet S included in the paper bundle B". The paper detection roller 91 is movable in a thickness direction of the paper sheet S by a support member (not illustrated).

The paper behavior detection sensor 51 is provided between the paper detection roller 91 and the pickup roller 47 in the paper carrying direction X. In the present embodiment, the paper behavior detection sensor 51 detects bending of the paper sheet S as a behavior of the paper sheet S sent by the paper detection roller 91. However, a configuration of the paper behavior detection sensor 51 is not limited to the above configuration. For example, the paper behavior detection sensor 51 may be connected to the support member supporting the paper detection roller 91 so as to detect bending of the paper sheet S on the basis of a change in a height position of the paper detection roller 91 lifted due to bending of the paper sheet S, in the same manner as in the second embodiment.

Here, FIG. 12 illustrates a case where the paper sheet S is normally sent by the paper detection roller 91 (a case where the paper bundle B and the packaging member P satisfy the predetermined conditions). As illustrated in FIG. 12, if the paper detection roller 91 is driven in a state in which movement of the leading end of the paper sheet S is restricted by the pickup roller 47, bending occurs in the paper sheet S. In this case, the paper behavior detection sensor 51 detects the bending of the paper sheet S.

Figure 13:
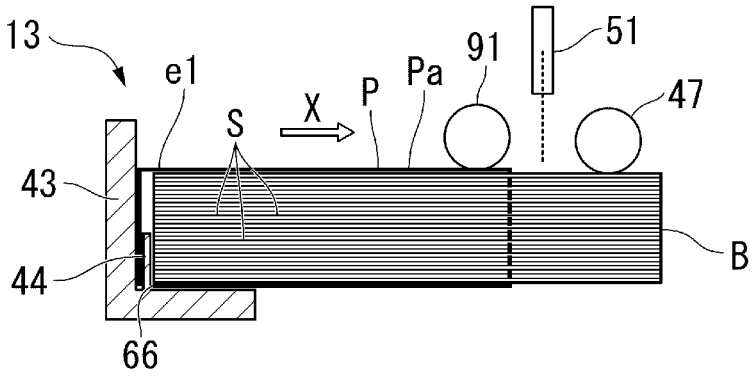
FIG. 13 is a sectional view illustrating a partial configuration of the paper feeding unit.

On the other hand, FIG. 13 illustrates a case where the paper sheet S is not normally sent by the paper detection roller 91 (a case where the paper bundle B and the packaging member P do not satisfy the predetermined conditions). As illustrated in FIG. 13, if the paper sheet S is not normally sent by the paper detection roller 91, bending does not occur in the paper sheet S. In this case, the paper behavior detection sensor 51 does not detect bending of the paper sheet S.

Here, for example, the paper detection roller 91 is disposed to be located above the packaging member P in a state in which the paper bundle B and the packaging member P are accommodated in the paper feeding cassette 41. According to this configuration, the paper sheet S is not reliably sent if some paper sheets S included in the paper bundle B are not placed on the packaging member P.

In the present embodiment, if it is detected that the paper bundle B is accommodated in the paper feeding cassette 41, the control unit 17 stops rotation of the pickup roller 47, and also drives the paper detection roller 91. The control unit 17 determines whether or not a behavior of the paper sheet S (bending of the paper sheet S) is detected by the paper behavior detection sensor 51. In the present embodiment, if bending of the paper sheet S is detected by the paper behavior detection sensor 51, the control unit 17 determines that the paper bundle B and the packaging member P satisfy the predetermined conditions.

On the other hand, if a behavior of the paper sheet S (bending of the paper sheet S) is not detected by the paper behavior detection sensor 51, the control unit 17 determines that the paper bundle B and the packaging member P do not satisfy the predetermined conditions. In this case, the control unit 17 controls the user interface 16 to perform a notification of the guidance again.

According to this configuration, it is possible to improve convenience in the same manner as in the second embodiment.

Next, a description will be made of several modification examples applicable to the first to third embodiments. Other configurations than those described below in each modification example are the same as the configurations in the first embodiment.

First Modification Example

Figure 14:
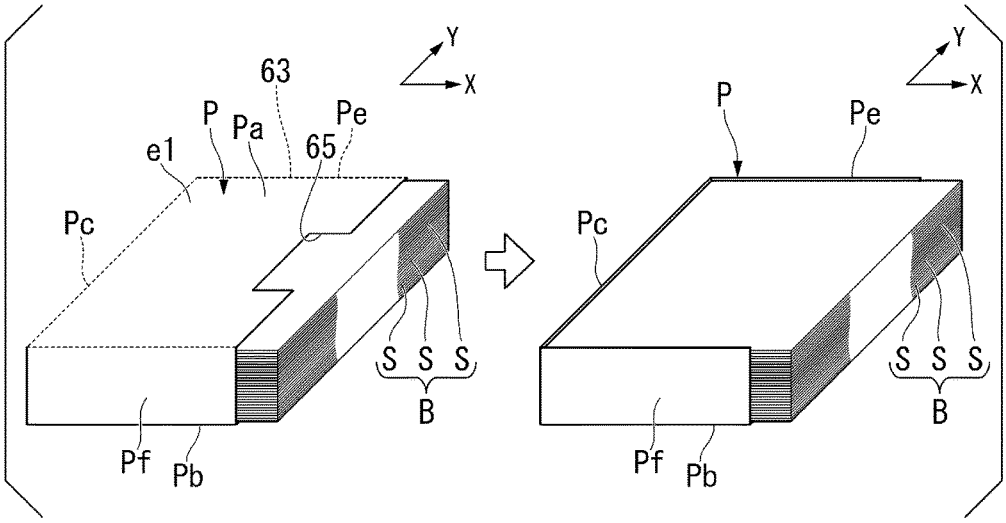
FIG. 14 is a perspective view illustrating a packaging member according to a first modification example of the first to third embodiments.

FIG. 14 is a perspective view illustrating the packaging member P of a first modification example. A left part in FIG. 14 illustrates the packaging member P in a state right after the paper bundle B and the packaging member P are accommodated in the paper feeding cassette 41. On the other hand, a right part in FIG. 14 illustrates the packaging member P in a state right before the paper feeding cassette 41 is closed with respect to the casing 11.

As illustrated in FIG. 14, the packaging member P of the present modification example has a third cutting guide line 63 in addition to the above-described first cutting guide line 61 and second cutting guide line 62. The third cutting guide line 63 is, for example, perforations. The third cutting guide line 63 is continuously provided along a boundary between the upper surface Pa and the first side surface Pc, a boundary between the upper surface Pa and the third side surface Pe, and a boundary between the upper surface Pa and the fourth side surface Pf. If the packaging member P is cut along the third cutting guide line 63, at least a part of the upper surface Pa of the packaging member P is separated and removed over the upstream side end e1 and the downstream side end e2 of the packaging member P from the packaging member P. For example, if the packaging member P is cut along the third cutting guide line 63, the entire upper surface Pa of the packaging member P is removed from the remaining portion PR of the packaging member P.

In the present modification example, the paper bundle B and the packaging member P are accommodated in the paper feeding cassette 41 in a state in which the open portion PO of the packaging member P is removed, and then at least a part of the upper surface Pa of the packaging member P is removed over the upstream side end e1 and the downstream side end e2 of the packaging member P. In the present modification example, at least a part of the upper surface Pa of the packaging member P being removed over the upstream side end e1 and the downstream side end e2 of the packaging member P is included in the "predetermined conditions". However, in the present modification example, the case where some paper sheets S included in the paper bundle B are pulled out of the packaging member P and placed on the upper surface Pa of the packaging member P is not included in the "predetermined conditions".

Second Modification Example

Figure 15:
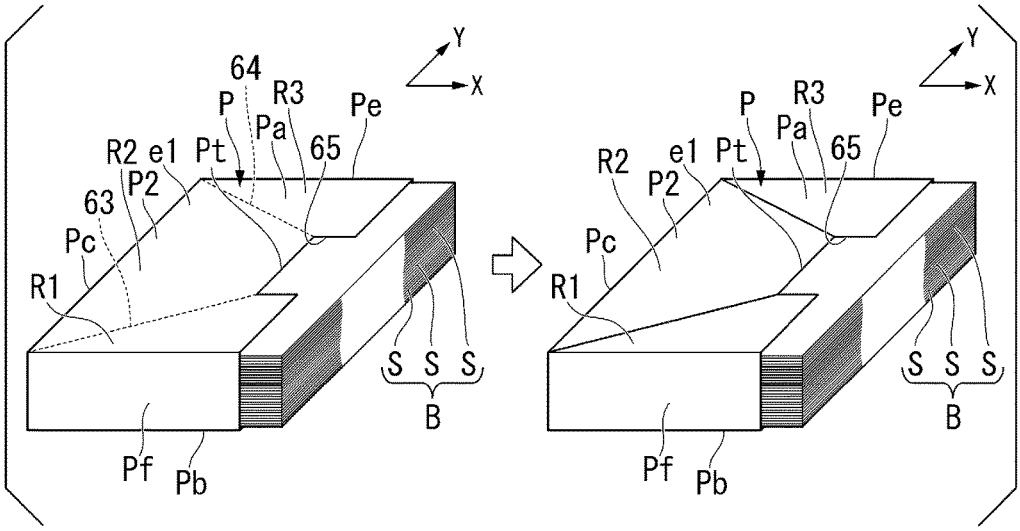
FIG. 15 is a perspective view illustrating a packaging member according to a second modification example.

FIG. 15 is a perspective view illustrating the packaging member P of a second modification example. A left part in FIG. 15 illustrates the packaging member P in a state right after the paper bundle B and the packaging member P are accommodated in the paper feeding cassette 41. On the other hand, a right part in FIG. 15 illustrates the packaging member P in a state right before the paper feeding cassette 41 is closed with respect to the casing 11.

As illustrated in FIG. 15, the packaging member P of the present modification example has a third cutting guide line 63 and a fourth cutting guide line 64 in addition to the above-described first cutting guide line 61 and second cutting guide line 62. Each of the third cutting guide line 63 and the fourth cutting guide line 64 is, for example, perforations. Each of the third cutting guide line 63 and the fourth cutting guide line 64 is provided over an edge Pt of the packaging member P defined by the first cutting guide line 61, and a boundary between the upper surface Pa and the first side surface Pc. If the packaging member P is cut along the third cutting guide line 63 and the fourth cutting guide line 64, the upper surface Pa of the packaging member P is cut to be divided into a plurality of regions R1, R2 and R3 in a direction (for example, a sheet width direction Y) intersecting the paper carrying direction X. If the upper surface Pa of the packaging member P is cut into the plurality of regions R1, R2 and R3, the friction between the paper sheet S and the paper sheet S, and the friction between the paper sheet S and the packaging member P are reduced. Therefore, a carrying force of a paper takeout member exceeds the friction, and thus paper feeding can be stably performed. Either one of the third cutting guide line 63 and the fourth cutting guide line 64 may be used.

In the present modification example, the paper bundle B and the packaging member P are accommodated in the paper feeding cassette 41 in a state in which the open portion PO of the packaging member P is removed, and then the upper surface Pa of the packaging member P is cut to be divided into the plurality of regions R1, R2 and R3 in the direction intersecting the paper carrying direction X. In the present modification example, the upper surface Pa of the packaging member P being cut to be divided into two or more regions in the direction intersecting the paper carrying direction X is included in the "predetermined conditions". However, in the present modification example, the case where some paper sheets S included in the paper bundle B are pulled out of the packaging member P and p laced on the packaging member P is not included in the "predetermined conditions".

Third Modification Example

Figure 16:
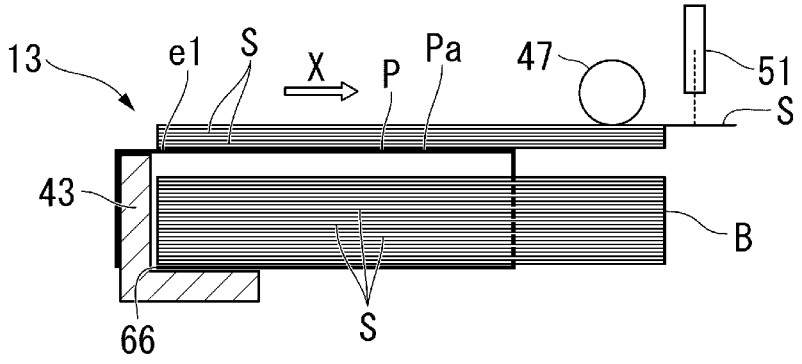
FIG. 16 is a sectional view illustrating a partial configuration of a paper feeding unit according to a third modification example.

FIG. 16 is a sectional view illustrating a partial configuration of the paper feeding unit 13 according to a third modification example.

As illustrated in FIG. 16, in the present modification example, the opening 66 of the packaging member P is provided at a position corresponding to the end guide 43 of the paper feeding unit 13. The end guide 43 passes through the opening 66 of the packaging member P if the paper bundle B and the packaging member P are accommodated in the paper feeding cassette 41. Consequently, at least a part of the end guide 43 is inserted into the packaging member P in a state in which the paper bundle B and the packaging member P are accommodated in the paper feeding cassette 41. The end guide 43 fixes a position of the packaging member P so that the packaging member P is not moved even if the paper sheet S is sent by the pickup roller 47 and the paper feeding roller 49.

Fourth Modification Example

Figure 17:
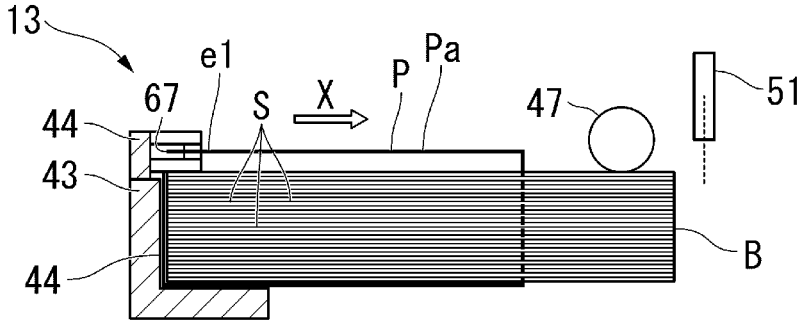
FIG. 17 is a sectional view illustrating a partial configuration of a paper feeding unit according to a fourth modification example.

FIG. 17 is a sectional view illustrating a partial configuration of the paper feeding unit 13 according to a fourth modification example.

As illustrated in FIG. 17, in the present modification example, the packaging member P has an opening 67. The opening 67 is provided on the first side surface Pc of the packaging member P. The opening 67 is formed by cutting a part of the packaging member P along a fifth cutting guide line 95 (refer to FIG. 3).

In the present modification example, the holding member 44 is provided on an upper end of the end guide 43. For example, the holding member 44 is, for example, a holder pinching a part of the packaging member P. A part of the holding member 44 passes through the opening 67 of the packaging member P if the paper bundle B and the packaging member P are accommodated in the paper feeding cassette 41. The holding member 44 fixes a position of the packaging member P so that the packaging member P is not moved even if the paper sheet S is sent by the pickup roller 47 and the paper feeding roller 49.

As mentioned above, the first to third embodiments, and several modification examples have been described. However, configurations of the embodiments are not limited to the above-described examples. For example, a notification unit notifying a user of the predetermined conditions may be an indicator 101 (refer to FIG. 1) provided at a position viewed if the paper feeding cassette 41 is extracted from the casing 11, instead of the user interface 16.

According to at least one of the above-described embodiments, the image forming apparatus includes the notification unit performing a notification of guidance on predetermined conditions required to be satisfied by at least one of a paper bundle and a packaging member, and can thus improve convenience.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A guidance method for paper feeding work, comprising:

performing a notification of guidance on predetermined conditions required to be satisfied by at least one of a paper bundle and a packaging member if both of the paper bundle and the packaging member used to package the paper bundle are accommodated in an accommodation unit of an image forming apparatus;

detecting that the paper bundle is accommodated in the accommodation unit by a first sensor;

sending a paper sheet from the paper bundle of the accommodation unit with a pickup roller;

sending a paper sheet which is sent by the pickup roller with a feeding roller;

detecting a behavior of the paper sheet sent by the pickup roller using a second sensor, a second roller is between the pickup roller and the feeding roller; and performing a notification of the guidance when a behavior of the paper sheet is not detected by the second sensor if the first sensor detects that the paper bundle is accommodated in the accommodation unit, and the pickup roller is driven.

2. The method according to claim 1, wherein the notification of the guidance is performed when a behavior of a paper sheet is not detected if it is detected that the paper bundle is accommodated in the accommodation unit, and a roller sending the paper sheet included in the paper bundle is driven.

3. The method according to claim 2, wherein the notification of the guidance is performed when bending of the paper sheet is not detected if movement of a leading end of the paper sheet is restricted, and the roller is driven.

* * * * *